US006619047B2

(12) United States Patent
Ziegler et al.

(10) Patent No.: US 6,619,047 B2
(45) Date of Patent: Sep. 16, 2003

(54) METHOD AND DEVICE FOR A COOLING SYSTEM

(75) Inventors: Bruno Ziegler, Pfungen (CH); Robert Sebastianutto, Schwerzenbach (CH); Juergen Clausen, Konstanz (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 10/175,154

(22) Filed: Jun. 20, 2002

(65) Prior Publication Data

US 2003/0024251 A1 Feb. 6, 2003

(30) Foreign Application Priority Data

Jun. 20, 2001 (DE) ..... 101 29 780

(51) Int. Cl.[7] ..... F17C 7/04; F17C 9/02
(52) U.S. Cl. ..... 62/48.1
(58) Field of Search ..... 62/48.1, 48.2, 62/48.3, 500, 116

(56) References Cited

U.S. PATENT DOCUMENTS 2,964,917 A * 12/1960 Webster ..... 62/50.3
3,874,185 A * 4/1975 Etzbach ..... 62/48.2
3,933,003 A 1/1976 Markum
4,249,387 A * 2/1981 Crowley ..... 62/48.2
4,548,053 A * 10/1985 Brown ..... 62/500
4,689,064 A * 8/1987 Boulanger et al. ..... 62/47.1
4,727,723 A * 3/1988 Durr ..... 62/48.2
4,886,534 A * 12/1989 Castan ..... 62/603
5,176,002 A * 1/1993 O'Brien et al. ..... 62/48.2

FOREIGN PATENT DOCUMENTS

DE 19718092 8/1998
DE 19755484 * 6/1999

OTHER PUBLICATIONS

English translation of DE 19755484 A1.

* cited by examiner

*Primary Examiner*—William C. Doerrler
(74) *Attorney, Agent, or Firm*—Crowell & Moring LLP

(57) ABSTRACT

A method for a cooling system operates by vaporizing liquid nitrogen at sub-atmospheric pressure subsequently compressing and then warming the vaporized nitrogen. A device for a cooling system which operates by vaporizing liquid nitrogen at sub-atmospheric pressure subsequently compressing and then warming the vaporized nitrogen has a pressure venting or metering device, which serves the pressure venting or metering of the liquid nitrogen, a container, in which the released nitrogen is conducted and from which refrigeration is discharged to at least one refrigeration consumer, a heat exchanger which serves the super cooling of the liquid nitrogen and the warming of the vaporized nitrogen, and a compressor, which serves the compression of the vaporized nitrogen.

10 Claims, 2 Drawing Sheets

PRIOR ART

METHOD AND DEVICE FOR A COOLING SYSTEM

This application claims the priority of German Patent Document DE 101 29 780.7, filed Jun. 20, 2001, the disclosure of which is expressly incorporated by reference herein.

BACKGROUND AND SUMMARY OF THE INVENTION

The invention relates to a cooling system which operates by vaporization of liquid nitrogen at sub-atmospheric pressure and subsequent warming and compression of the vaporized nitrogen.

Further, the invention relates to a device for a cooling system which operates by the vaporization of liquid nitrogen at sub-atmospheric pressure and subsequent warming and compression of the vaporized nitrogen, with a pressure venting or metering device, which serves the pressure venting or metering of the liquid nitrogen, a container, into which the vented nitrogen is conducted and from which the cold is discharged to at least one refrigeration user, a heat exchanger, which serves the warming of the vaporized nitrogen, and a compressor, which is used to compresses the vaporized nitrogen.

Generic methods or devices for cooling systems are used, for example, for open and closed cooling processes to cool high temperature, super-conductive components. The components that are to be cooled are either integrated directly in the above-mentioned container or supplied with refrigeration from this container via a secondary circuit.

There are two basic possibilities for achieving temperatures below the boiling point of nitrogen. First, a refrigerant which has a lower boiling point than nitrogen can be used, for example, neon or helium. Second, nitrogen can be vaporized at sub-atmospheric pressure, warming it roughly to the ambient temperature and subsequently compressing it to atmospheric or hyperbaric pressure.

Other objects, advantages and novel features of the present invention will become apparent from the following detailed description of the invention when considered in conjunction with the accompanying drawings.

DETAILED DESCRIPTION OF THE DRAWINGS

Figure 1:
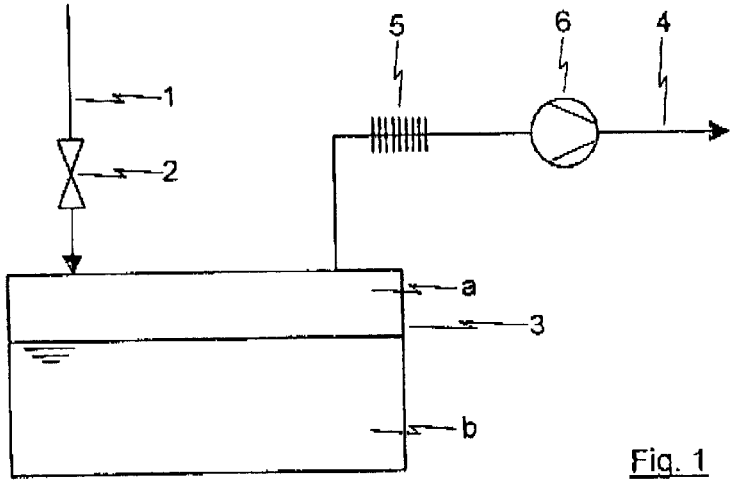
FIG. 1 depicts a diagrammatic view of a conventional cooling system.

The novel features of the present invention may be best understood and appreciated after considering a conventional cooling system. As shown in FIG. 1, nitrogen is condensed along line 1 in an expansion or metering device which, preferably, is an expansion valve 2. The nitrogen is then subjected to pressure venting and fed to a container 3. There, a gaseous phase a and a liquid phase b are formed since the emission of cooling power causes the liquid nitrogen that is fed to the container to vaporize. The vaporized nitrogen is removed from the container 3 via line 4, and, upon warming to the ambient temperature in the heat exchanger 5, is compressed with the compressor 6 to atmospheric or hyperbaric pressure. Warming of the vaporized nitrogen in the heat exchanger 5 preferably occurs through interaction with the surrounding air, water, or the like, or through electric heating. While this cooling system may be suitable for some uses, an improved system and device would be an advance in the art.

It is an objective of the present invention to provide a method as well as a device for a cooling system, which may exhibit energy-related and device-related advantages compared to the above-described process for a cooling system through the vaporization of liquid nitrogen.

According to the invention, this objective is accomplished when the vaporized nitrogen is initially compressed and subsequently warmed, if necessary.

Compressors suitable for the inventive method may be conventional vacuum pumps, compressors, or other similar devices. Pursuant to the present invention, the compressor is arranged before the heat exchanger. While the term heat exchanger is used, and a heat exchanger may be preferred because it can serve a dual purpose, any device capable of warming the compressed nitrogen may be used.

The inventive method and the inventive device for a cooling system through the vaporization of liquid nitrogen, as well as additional designs for the same, will be explained in more detail in conjunction with the embodiments shown in FIGS. 2 and 3.

Figure 2:
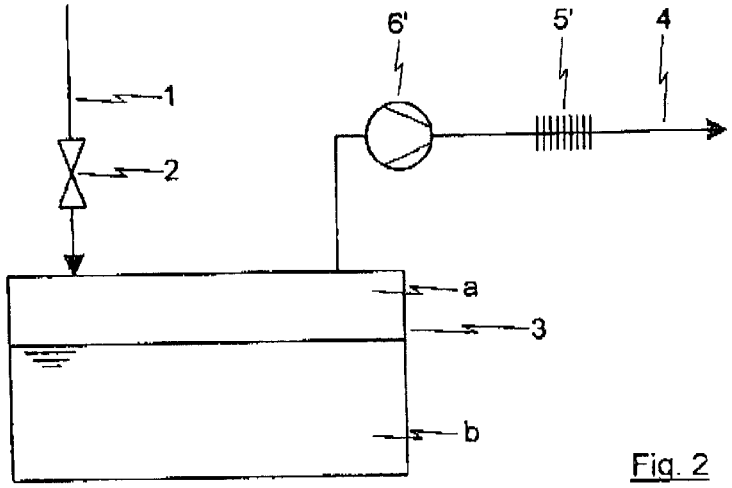
FIG. 2 depicts a diagrammatic view of one embodiment of a cooling system according to the present invention.
Figure 3:
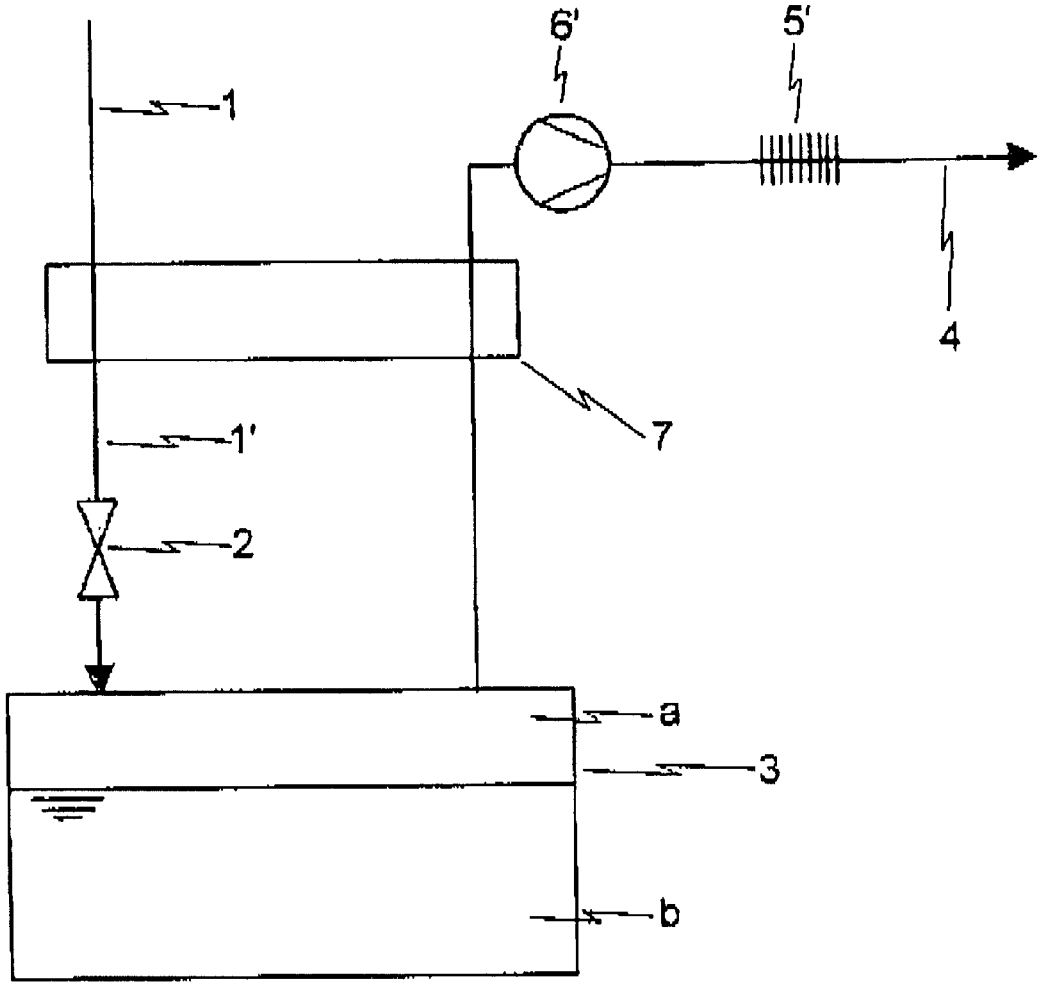
FIG. 3 depicts a diagrammatic view of a further embodiment of a cooling system according to the present invention.

In contrast to the processes based on the conventional system shown in FIG. 1, FIGS. 2 and 3 show a novel system where vaporized nitrogen is removed from the container 3, and is compressed in the compressor 6'. Compression in the compressor 6' occurs prior to warming to the ambient temperature in the heat exchanger 5'.

One or several cold compressors can be used as the compressor 6'. Because a device, according to the present invention, locates the compressor 6' before the heat exchanger, compression occurs at the boiling temperature of the nitrogen instead of at the ambient temperature.

An example of an appropriate cold compressor is a turbo-compressor of a radial type. Radial-type turbo-compressors can be designed specifically for use at very low temperatures.

In the embodiment shown in FIG. 3, one additional heat exchanger 7, is arranged before the cold compressor 6'. This heat exchanger 7 provides the super cooling of the liquid nitrogen in the line 1 by using the temperature differential of the vaporized nitrogen that has been removed from the container 3. This process not only super-cools the liquid nitrogen, it also slightly warms the vaporized nitrogen in line 1. Nitrogen that has been super cooled this way in heat exchanger 7 is subsequently fed to the expansion valve 2 via the line 1'.

The inventive method and the inventive device thereby lead to a reduction in the driving power of the compressor 6' since compression takes place at low temperatures. Heat exchanger 5' can therefore be of a smaller design Optionally, heat exchanger 5' can be completely omitted.

A further benefit, according to the present invention, provides that smaller compressors may be utilized for the compression of nitrogen at sub-atmospheric pressure. This is due to the lower intake temperature and consequent greater density of the nitrogen when it reaches the compressor.

Yet another benefit of the present invention is the operation and maintenance of fewer devices, instruments, etc. at sub-atmospheric pressure. This benefit reduces the likelihood of contamination of the process gas through leakage, which is particularly important for a closed process. This may also provide cost savings in construction and operation.

The inventive method and the inventive device for a cooling system thus lead to a simplification of the process, a cost reduction, an increase in process efficiency, and an improvement of the operating safety as well as availability.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A process for operating a cooling system which is adapted to vaporize liquid nitrogen at sub-atmospheric pressure and subsequently produce warmed and compressed vaporized nitrogen comprising:

forming gaseous and liquid nitrogen phases in a container from nitrogen which is subjected to pressure venting and fed to the container;

removing vaporized nitrogen from the container;

compressing the vaporized nitrogen at a boiling temperature of the nitrogen prior to any warming of the vaporized nitrogen in a heat exchanger from which the warmed and compressed vaporized nitrogen is supplied.

2. The process according to claim 1, and further comprising using the vaporized nitrogen removed from the container for super-cooling the nitrogen before it is subjected to pressure venting.

3. The process according to claim 1, wherein compressing the vaporized nitrogen occurs through the use of a cold compressor.

4. The process according to claim 2, wherein compressing the vaporized nitrogen occurs through the use of a cold compressor.

5. A cooling system which is adapted to vaporize liquid nitrogen at sub-atmospheric pressure and subsequently produce warmed and compressed vaporized nitrogen comprising:

a container in which gaseous and liquid nitrogen phases can be formed from nitrogen which is subjected to pressure venting or metering and fed to the container;

a line by which vaporized nitrogen is removable from the container;

a heat exchanger from which the warmed and compressed vaporized nitrogen is supplied, and a compressor adapted to compress the vaporized nitrogen at a boiling temperature of the nitrogen prior to any warming of the vaporized nitrogen in the heat exchanger.

6. The cooling system according to claim 5, wherein said container is adapted for use by at least one refrigerant user.

7. The cooling system according to claim 5, and further comprising another heat exchanger, serving to exchange heat with the liquid nitrogen, arranged in said line before the compressor.

8. The cooling system according to claim 5, wherein the compressor is a cold compressor.

9. The cooling system according to claim 6, wherein the compressor is a cold compressor.

10. The cooling system according to claim 7, wherein the compressor is a cold compressor.

* * * * *